United States Patent [19]

Lauzier

[11] 4,015,826

[45] Apr. 5, 1977

[54] ADJUSTABLE MOUNTING ASSEMBLY FOR RAILING

[76] Inventor: René Lauzier, Ruy 38300, Bourgoin Jallieu, France

[22] Filed: Dec. 2, 1974

[21] Appl. No.: 528,893

[52] U.S. Cl. ..... 256/59; 248/354 R; 403/87

[51] Int. Cl.[2] ..... E04B 17/14; F16C 11/06

[58] Field of Search ..... 256/24, 59, 58, 32, 256/65; 52/704, 698; 248/288, 188.2, 357, 160, 181; 182/87, 82; 312/254, 255, 256; 403/87, 162, 115, 116

[56] References Cited

UNITED STATES PATENTS

| | | | |
|---|---|---|---|
| 531,054 | 12/1874 | McCoy | 403/87 |
| 656,314 | 8/1900 | Beerbower | 256/65 |
| 1,210,411 | 1/1917 | Bryhan | 248/23 |
| 3,204,898 | 9/1965 | Manning | 248/181 |
| 3,361,410 | 1/1968 | Messer | 248/354 |

*Primary Examiner*—Dennis L. Taylor
*Attorney, Agent, or Firm*—Karl F. Ross; Herbert Dubno

[57] ABSTRACT

A railing is secured to a base by means of a mounting assembly comprising an upright mounting post provided at its lower end with a foot that is bolted against a mounting block on the base. The upper surface of the mounting block and the lower surface of the foot correspond to complementary surfaces of a segment of a torus and the bolt that passes through the two elements is offset from a radius of rotation of the torus. The mounting post is adjusted by displacing the mounting block underneath its foot until the post is perfectly vertical.

1 Claim, 4 Drawing Figures

ADJUSTABLE MOUNTING ASSEMBLY FOR RAILING

FIELD OF THE INVENTION

The present invention relates to a mounting assembly for a railing. More particularly this invention concerns a mounting post or baluster for a balcony railing.

BACKGROUND OF THE INVENTION

A prefabricated railing is usually secured to the balcony or other base on which it is mounted by means of support-post assemblies spaced apart by a distance of 1 to 2 meters. It is necessary that the railing be extremely rigidly secured so as to be able to withstand outward forces of from 100 to 300 kilograms without breaking.

It is necessary that such a mounting assembly be adjustable within certain limits so as to allow the mounting post to be perfectly aligned even when the base is irregular or nonhorizontal. This is particularly the case when the mounting assembly is being used on a balcony which is pitched slightly outwardly so as to allow water to run off. It is also necessary that such mounting assemblies allow the railing to be mounted on the extreme outer edge of the balcony so as to allow the users to benefit from the maximum amount of space on the balcony within the railing.

It has been suggested to mount the support posts on the base by means of shims which either may have flat parallel faces or be wedge-shaped. This allows a limited adjustment, but makes it almost impossible to tip the post relative to the base.

Another useful arrangement uses a base having three support points, two of which are constituted by adjustable screws so as to allow the foot of the support post to be tipped in virtually any direction and compensate therefore for virtually any type of irregularity in the base. The difficulty of this arrangement is that the foot of the support post is always spaced slightly from the base. This allows water between the foot and the base and therefore can be considerably disadvantageous in the case of freezing of this water and at the same time corrosion of the foot of the mounting post is unavoidable. Another disadvantage is that any lateral force exerted on the mounting post will be effective over a very limited area on the base so that it is possible for the cement to be rapidly pulverized beneath the mounting points of the foot of the support post.

In another known system a mounting block is provided on the base which has a semispherical upper surface and the mounting post has a foot formed with a downwardly concave complimentary semispherical surface that allows the post to rock all-and-socket fashion on the mounting block. A mounting screw passes vertically up through the centers of the two semispherical surfaces. Such a solution is indeed satisfactory from a purely geometric point of view, but has the considerable disadvantage that the mounting post is unable to withstand lateral forces to any significant extent as the mounting screw alone resists displacement of the two elements relative to each other. Furthermore severe misalignment of the mounting block and the support post creates an ugly and highly undesireable appearance.

OBJECTS OF THE INVENTION

It is therefore an object of the present invention to provide an improved railing mounting assembly.

Another object is the provision of such an assembly which can be mounted at the very edge of a balcony or the like and can withstand considerable lateral forces.

A further object is to provide a mounting assembly which is limitedly adjustable and inexpensive to manufacture.

SUMMARY OF THE INVENTION

These objects are attained according to the present invention in a mounting assembly for securing a railing to a base and comprising a support post having a foot formed with a downwardly concave recess that complementarily fits an upwardly convex mounting block bolted to the base. The complementary surfaces of the foot and the mounting block are constituted at surfaces of a segment of a torus having an axis of revolution which is horizontal and generally parallel to the upper plane surface of the base and to the railing.

Thus it is possible to adjust the post on the base simply by sliding its mounting block under the foot such that effectively it is rotating about an axis which is the axis of revolution of the toroidal surface. The foot remains perfectly guided by the mounting block so that no error of orientation is possible, contrary to that which can happen when part-spherical surfaces are used. Similarly it is possible to tip the post laterally. In this case the post is not perfectly guided but, as the amount of tipping necessary is rarely more than 2°, this is not important. On the contrary a small radius of curvature of the torus in the transverse sense has several advantages: the foot of the support post can be made more massive and any misalignment of the foot of the support post with the will not be readily apparent.

In accordance with another feature of the invention the screw means which secures the foot and mounting block to the base is provided offset from a vertical plane bisecting the imaginary torus and passing perpendicular to the axis of rotation thereof. It is necessary that this mounting screw be as far as possible from the edge of the balcony. It has been determined that with a 12 mm screw it is necessary to space this at 140 mm from the edge of the balcony or base, whereas with a 10 mm screw only 120 mm of spacing is necessary. With, for example, this 12 mm screw one can use anchors capable of withstanding a withdrawal force of between 2 and 2.3 tons. Thus the coefficient of friction between the two metallic pieces of the screw and the anchor is approximately 0.50, usually reduced to 0.30 when any unavoidable contaminants find their way into the assembly. Thus the maximum effort which can be withstood at the periphery of the torus is equal to $200 \times 0.3 = 600$kg force. Thus it is necessary to have a ratio of ½ between the exterior radius of the torus and the sum of the height of the balcony plus the exterior radius of the torus, if the top of the railing is to resist a lateral force equal to 300kg with a screw that is placed at the axis of a vertical plane bisecting the torus and including the rotation axis thereof. To achieve this it would be necessary to use an extremely large mounting block which would be ugly and dangerous so as to have the necessary adjustability.

In accordance with the present invention however the exterior diameter of the torus is relatively limited whereas the mounting block allows a relatively great amount of tipping of the support post relative to this mounting block. A placement of the screw in back of the axis of revolution of the torus adds to the friction between the elements of the mounting assembly so as to allow a considerable diminution in the external radius of the torus, thereby saving both space and materials while obtaining the same safety features. The result is an attractive and inexpensive arrangement for mounting a railing on a balcony or the like which can nontheless withstand relatively large lateral forces tending to tip the post relative to the balcony. At the same time the post can be mounted at the very lip of the balcony so as to allow all of the usable space thereof to be employed.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
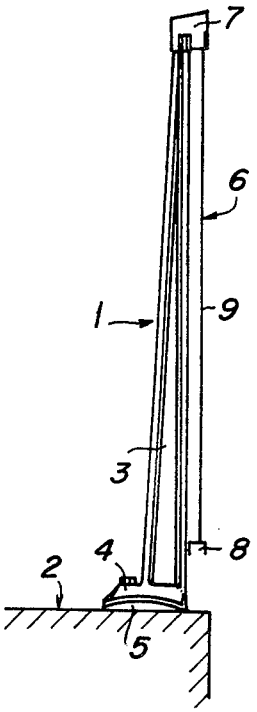
FIG. 1 is an end view of a mounting assembly according to the present invention.

As shown in FIG. 1 a mounting assembly 1 has a support post 3 provided with a foot 4 secured via a mounting block 5 to a reinforced-concrete base 2 constituting the edge of a balcony. The assembly 1 serves to mount a railing 6 comprising a handrail 7, a lower rail 8, and a group of spindles 9 extending vertically between the generally horizontal rails 7 and 8.

Figure 4:
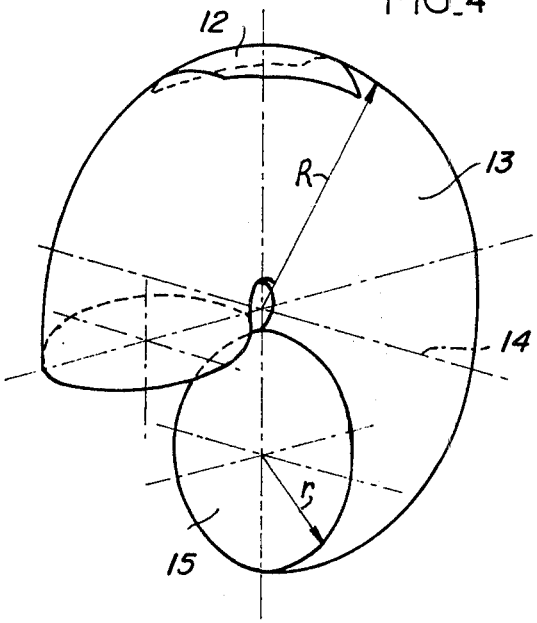
FIG. 4 is a perspective view of a torus illustrating principles of the present invention.
Figure 2:
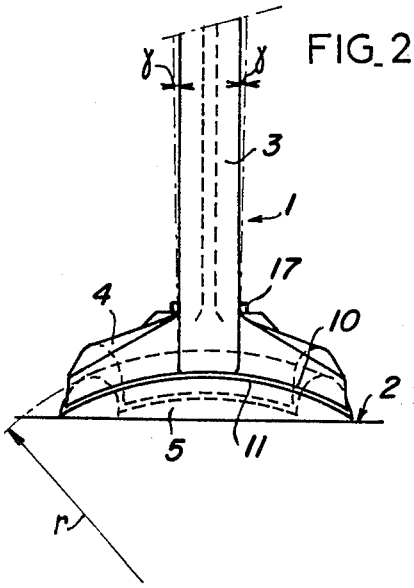
FIG. 2 is a side view of the lower end of the assembly shown in FIG. 1, in enlarged scale.

The foot 4 is formed with a downwardly concave recess 10 which rests on a complementary upwardly convex surface 11 of the mounting block 5. As shown in FIG. 4 these surfaces 10 and 11 are constituted as surfaces of a segment 12 of a torus 13 having an axis of revolution 14 and being of circular section 15. This torus 13 has an exterior radius R which is substantially greater than the radius of curvature $r$ of its circular section 15.

Figure 3:
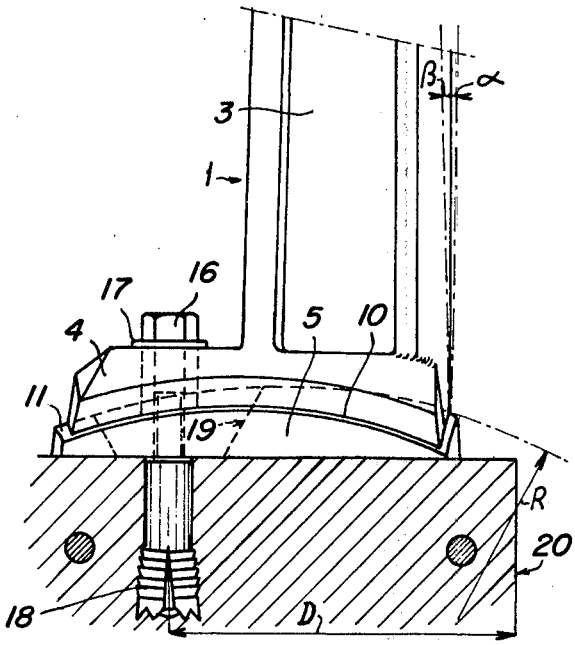
FIG. 3 is an end view of the structure shown in FIG. 2, partly in section.

A mounting screw 16 passes through a washer 17 and corresponding bores in the foot 4 and in the mounting block 5 so as to screw into an anchor 18 sunk in the reinforced-concrete base 2 at a distance D from the edge 20 thereof. The hole 19 through the mounting block 5 is as shown in FIG. 3 of substantially greater dimensions than the screw 16 so as to permit relative displacement of these two elements.

In order to withstand a force of 300kg at the handrail 7 the radii R and $r$ the torus are respectively 220 mm and 100 mm, the screw 16 has a diameter of 12 mm and is spaced at a distance D from the edge 20 equal to 140 mm.

The assembly is adjusted by sliding the block 5 relative to the foot 4. This relative displacement is carried out before the screw 16 is tightened down.

To start with the block is displaced in a plane from front to back, that is toward and away from the edge 20 so as to compensate for any nonhorizontal orientation of the base 2 serving to allow water to run off. Since the two surfaces 10 and 11 are perfectly complementary this is carried out relatively easily. In practice the angular displacement $\alpha$ outwardly is equal to approximately 2° and the displacement backwardly $\delta$ to approximately 4°, although any reasonable adjustment is possible.

Thereafter the assembly is adjusted transversely which is normally necessary to compensate for minor construction flaws in the cement and which rarely amounts to more than an angular displacement $\delta$ of more than 2°. Such a transverse adjustment is aided by using relatively soft aluminum or steel for the foot 4 and mounting block 5 so that the slight noncomplementary aspects of the two surfaces in this direction are fully compensated for and a perfect seating is obtained.

Although the invention has been described with reference to a railing it should be noted that it could be used to mount any other type of support post or support where a certain amount of adjustability is required while at the same time a very rigid securing is also necessary.

I claim:

1. A railing assembly comprising:

an elongated railing; a base, said assembly comprising:

a support post secured to said railing and having a foot formed with a downwardly turned recess having a toroid-segmental surface;

a mounting block on a base for said railing and having an upwardly facing toroid-segmental surface complementary to said surface of said foot and at least partially receivable in said recess; and screw means engageable through said foot and said block and with said base for bolting said foot to said base, said block and foot surfaces being shaped as mutually complementary surfaces of a segment of a common torus having an axis of revolution parallel to said railing, said screw means including a single screw passing through said foot and said mounting block at a location to one side of a vertical plane passing through said axis.

* * * * *